United States Patent [19]

Goodrich

[11] 4,062,056

[45] Dec. 6, 1977

[54] MULTIPLE CODE ELECTRONIC COMBINATION DOOR LOCK

[76] Inventor: David E. Goodrich, 3327 Winthrop Ave., Suite 157, Fort Worth, Tex. 76116

[21] Appl. No.: 589,796

[22] Filed: June 23, 1975

[51] Int. Cl.[2] ..... E05B 49/00

[52] U.S. Cl. ..... 361/172; 70/278

[58] Field of Search ..... 317/134; 70/278, 280; 340/147 MD, 164 R, 164 A; 361/172

[56] References Cited

U.S. PATENT DOCUMENTS

| | | | |
|---|---|---|---|
| 3,321,673 | 5/1967 | Wolfe | 317/134 |
| 3,800,284 | 3/1974 | Zucker et al. | 340/147 MD X |
| 3,845,361 | 10/1974 | Watase et al. | 317/134 |

*Primary Examiner*—Harry E. Moose, Jr.
*Attorney, Agent, or Firm*—Robert A. Felsman

[57] ABSTRACT

The electronic combination door lock has three codes, each of which if properly actuated will allow the door to open. Signal switches are connected in parallel with two sets of resettable multiposition switches. The multiposition switches enable setting the first and second codes and transmit the signals generated by the signal switches selected to a logic circuit or sequence detector that detects the sequence of the signals. If the sequence is correct, the sequence detector provides an output to solenoid circuitry to release the lock. A third code circuit is in parallel with the first and second codes and also provides a connection from selected signal switches to the sequence detector. An error detecting circuit counts all actuations of the signal switches and resets the sequence detector if the generated signals exceed the number of digits in the code. Mechanical locks and covers are used in combination with the electronic codes to prevent access to the signal switches and to the resettable parts of the multiposition switches. The mechanical locks also selectively activate the first, second or third code circuitry.

17 Claims, 9 Drawing Figures

170
HOUSE CODE
GUEST CODE
MAID CODE
KEYBOARD
205
29
83
81
142
138
173
171
91
175
241
177
89
5V
145
243
BLUE
33
149
143
139
167
147
168
141
169
153
151
165
245
12V
12V
263
OUT
TIME DELAY
KEY & CODE
95
KEY ONLY
127
GUEST CODE DOOR SOL
IN
100
98
102
108
106
12V
5V
104
73
MAID CODE DOOR SOL
195
197
CHANGE CODE
41
90
92
107
96
94
MAID KEY
5V
75
DOOR LATCH SOL
17

MULTIPLE CODE ELECTRONIC COMBINATION DOOR LOCK

BACKGROUND OF THE INVENTION

1. Field of the Invention

This invention relates in general to electronic combination locks and in particular to an electronic combination door lock for hotel, office building and apartment use.

2. Description of the Prior Art

Electronic combination door locks are available for controlling access from a non-secure area to a secure area. They normally have a single code, operable by pushbuttons, that must be sequentially generated for access. Means to select other combinations and to detect tampering are also known.

Door locks for hotels, however, have unique problems because of the turnover of new guests and because of the requirement for a maid or hotel employee to be able to enter while the guests is not in the room. If a single code combination is used, as is known in the prior art, the management must have knowledge of each new code set. Also in this case the guest is unable to independently reset the code, otherwise the maid would be unable to enter, unless an override is present.

SUMMARY OF THE INVENTION

It is accordingly a general object of this invention to provide an improved electronic combination door lock particularly for use in a hotel. It is a further object of this invention to provide means for allowing the guests to independently set any code desired in secrecy, yet still provide an effective and secure manner for a maid to enter for cleaning.

In accordance with these and other objects, a multicode combination lock is provided, having two resettable codes and one house code. If the particular code circuit is enabled, the insertion of the correct one of the three codes will allow the door to be opened. One resettable code is for maid operation, and is enabled only after a maid's mechanical key has been rotated. The second code is a resettable code for a hotel guest that is enabled only if a guest's mechanical key is initially rotated. The third code is normally a fixed house code of known digits, such as 1-2-3-4, for use of the newly arriving guest, since the prior guest's code would be unknown by anyone. This third code is enabled only if one has initially properly executed the maid or guest code then depressed a switch to place the house code into operation.

In normal operation, a maid uses the maid mechanical lock to obtain access to the pushbuttons or keys, then depresses the keys in maid code sequence to achieve entry. If the guest has checked out, the maid depresses a button to switch the mode to house code. A newly arriving guest must first use the guest mechanical key to obtain access to the pushbuttons or keys, then depresses the keys in accordance with the house code to achieve entry.

The guest may continue to use the house code or if he desires, he can switch to a resettable guest code. He may also elect to enter his room by means of a key only by setting the proper switch. The means to reset are located in a secure panel inside the room. The maid's code can also be frequently changed for security purposes by management, the means to do so located in another secure panel inside the room, not accessible to the guest.

Consequently, a guest has a resettable code which he may keep in absolute security. A maid may enter on her code, but is unable to discover the guest's code. Further security is provided by combining the electronic lock with mechanical locks for the guest and the maid. Many other features and advantages will be explained and become apparent hereinafter.

FIGS. *7a* and *7b* are a schematic circuit diagram of the electronic combination lock according to this invention.

Figure 8:
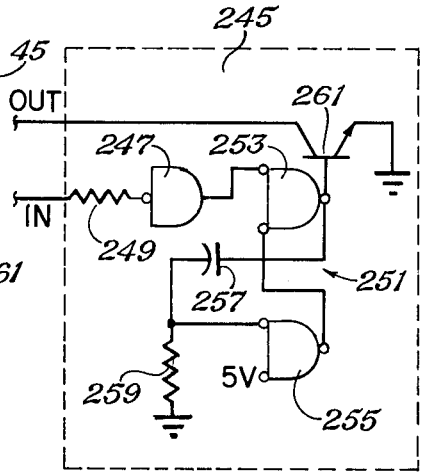

FIG. 8 is a schematic circuit diagram of the time delay circuit means of FIG. *7b*.

DESCRIPTION OF THE PREFERRED EMBODIMENT

Figure 1:
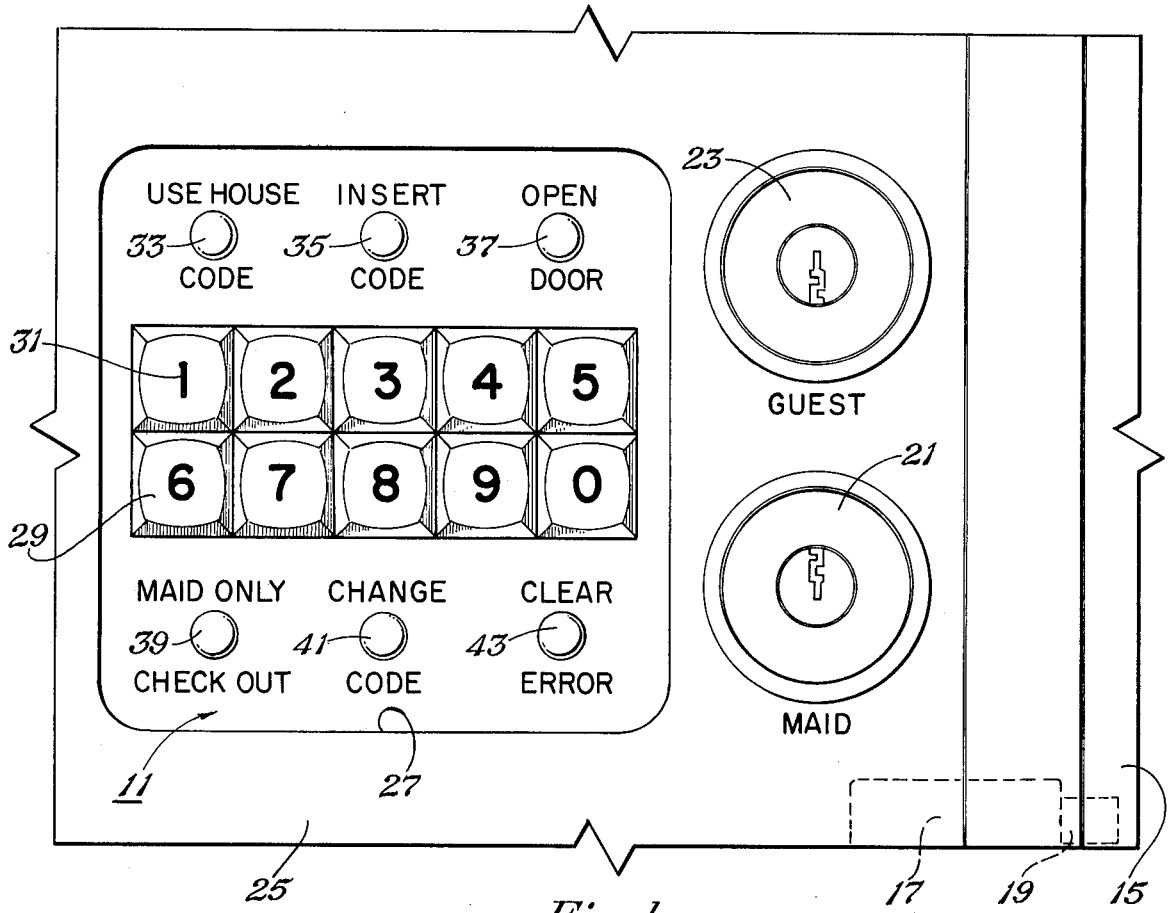
FIG. 1 is front elevational view of the control panel of the electronic combination lock located outside the hotel room.

A general description of the external and mechanical features will be initially given, beginning with reference to FIG. 1. A control panel 11 is mounted to the nonsecure or outside wall such as in a hotel hall, adjacent door 15. An electrically actuated control means, including solenoid 17 and latch 19, shown in phantom lines, are mounted within the wall in engagement with door 15. Energizing solenoid 17 causes the latch 19 to retract, allowing door 15 to open without the bolt (not shown) being withdrawn to provide access to the secure area or the inside of a hotel room. A conventional door knob (not shown) on the inside of door 15 withdraws the bolt mechanically so that one may exit from the room without any electronic circuit operation.

Located adjacent the control panel 11 are two mechanical key locks 21, 23 mounted on a wall plate or panel 25, which is affixed to the outside wall. The wall panel 25 surrounds the control panel 11 and has a window, indicated by numeral 27, for access to the control panel. The control panel 11 is recessed within the outside wall slightly, with the wall panel 25 in front.

The control panel 11 contains ten signal switches or keys 29, which are conventional and are actuated by depressing. Each key 29 bears an indicia 31 to indicate numerals used in the codes. Three lamps are affixed to the control panel 11 above the keys. Lamp 33 is a blue lamp that if on indicates that the third or house code should be inserted, or generated by the keys 29. Lamp 35 is an amber lamp that if on indicates that solenoid 17 has not released the door 15.

Lamp 37 is a green lamp that if on indicates that a code has been properly inserted and the solenoid has released the door 15.

Three pushbutton switches are located on the control panel 11 below the keys 29. Switch 39, labelled "checkout" is part of the code mode switching means, more specifically the second to third code switching means, which is the switch that changes the guest operation from a resettable code to the house code. Switch 41, labelled "change code" is actuated for resetting the codes and releases the electrical locking of the covers over the selection means inside the room, to be described below. Switch 43, labelled "clear error" clears signals erroneously generated by depressing the wrong keys 29 for a particular code.

Figure 2:
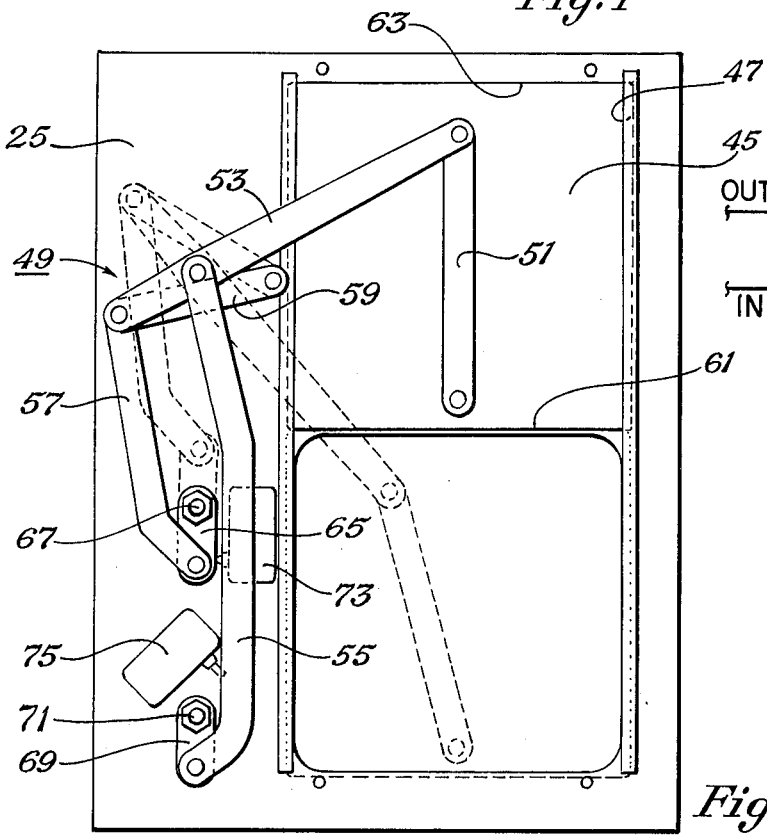
FIG. 2 is a rear elevational view of the control panel of FIG. 1 with the guest mechanical lock fully rotated.
Figure 3:
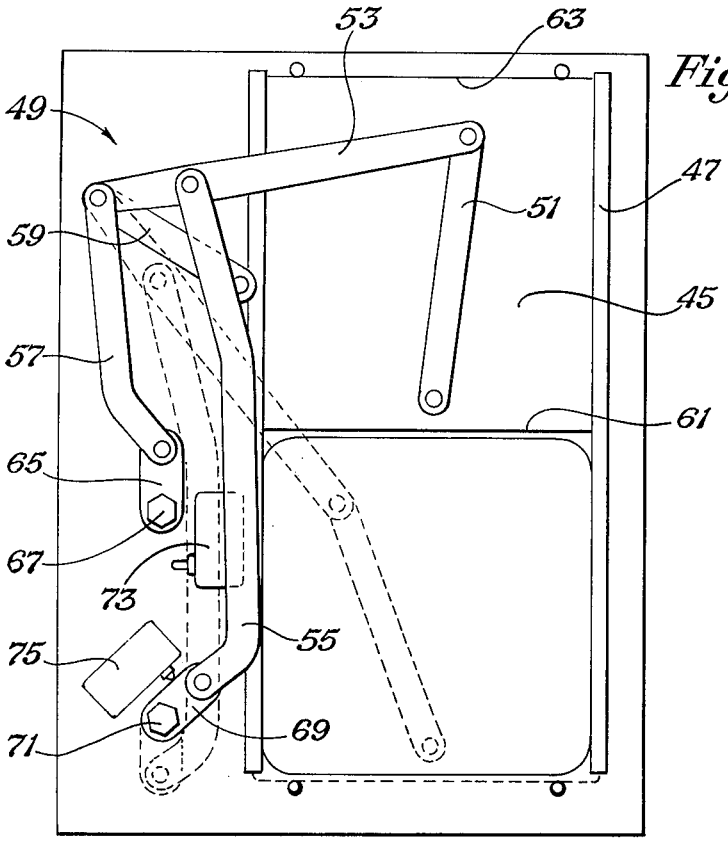
FIG. 3 is a rear elevational view of the control panel of FIG. 1 with the maid mechanical lock fully rotated.

Referring to FIG. 2, the rear view of FIG. 1, a cover, or control panel door 45, is mounted within channels 47 that allow the door to slide vertically in front of control panel 11. As the phantom lines of FIGS. 2 and 3 show, the control panel door 45 may be retracted to provide access to the control panel 11 by rotating independently the first or maid lock 21 or the second or guest lock 23.

Linkage means 49 connects the locks 21, 23 to the control panel door 45 for performing the sliding function. FIG. 2 shows the guest lock fully rotated with the door 45 open, while phantom lines show guest lock 23 and door 45 returned to the close position.

The linkage means 49 comprises five flat members pivotally connected to each other so that they are rotatable with respect to each other in a vertical plane. Drag link 51 is pivotally connected adjacent the bottom edge 61 of control panel door 45, and extends generally vertically to a position adjacent upper edge 63 of the door 45. A whiffle-tree link 53 is connected to the drag link 51 at this point and extends laterally to a point generally above the locks 21, 23. An overcenter link 57 connects this end of the whiffle-tree link 53 to guest lock 23 via a short member or key arm 65. Key arm 65 is rigidly attached to a rotating member 67 of the guest lock 23. A ground link 59 is connected from the inner section of the whiffle-tree link 53 and overcenter link 57 to the wall panel 25 adjacent control panel door 45. Another overcenter link 55 connects maid lock 21 with the whiffle-tree link 53 at an intermediate point on the whiffle-tree link. Overcenter link 55 is pivotally attached to a short member or key arm 69, which is rigidly connected to a rotating member 71 of maid lock 21.

The links of the linkage members 49 are selected so that rotating guest lock 23 while maid lock 21 is closed, pivots whiffle-tree link 53 on overcenter link 55 to slide the control panel door 45. Conversely rotating maid lock 21 while guest lock 23 is closed rotates whiffle-tree link 53 about the intersection of the whiffle-tree link and overcenter link 57, thus also raising control panel door 45.

Limit switches 73, 75 are mounted on the rear of wall panel 25 adjacent the rotating members 67, 71 of locks 23, 21. The first switch 75 is aligned so that full opening rotation of maid lock 21 causes key arm 69 to close it, as shown in FIG. 3. This energizes the maid code circuitry as will be explained below. Similarly, switch 73 is aligned so that full opening rotation of guest lock 23 causes key arm 65 to close it, as shown in FIG. 2, energizing the guest code circuitry.

Figure 4:
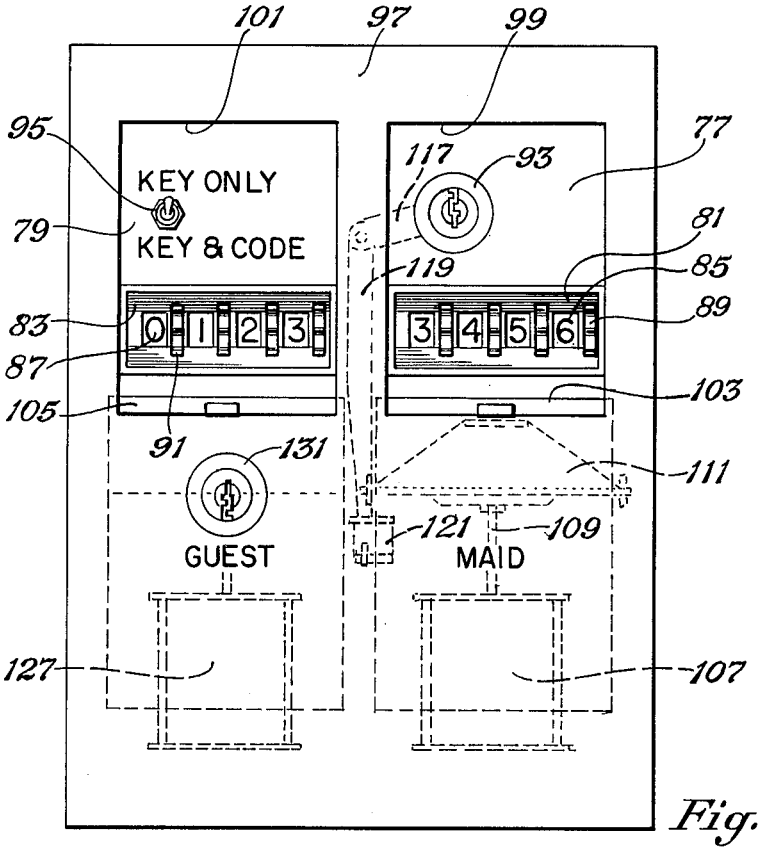
FIG. 4 is a front elevational view of the selector panels located inside the room.

FIG. 4 shows a front view of the panels for resetting the codes, located in a secure area or inside the hotel room. Two selector panels, maid selector panel 77, and guest selector panel 79, are mounted within the inner wall (not shown). Each selector panel 77, 79 carries multiposition switch 81, 83. Each multiposition switch has four digit rows of indicia 85, 87, serving as means for displaying the particular code selected in that circuit. Each digit row has an independent manually resettable switch 89, 91, serving as resetting means.

A mechanical lock 93 is mounted to the maid selection panel 77 directly above the multiposition switch 81. Operation switching means, or switch 95, is mounted to the guest selection panel 79 directly above the multiposition switch 83. Switch 95 enables the door 15 to be opened either by mechanical key or by mechanical key and code combined as will be described below.

A wall panel 97, having two windows, indicated as 99, 101, for access to the selection panel 77, 79, is affixed to the inner wall over selection panels 77, 79. Each window 99, 101 has a cover or selection panel door 103, 105 aligned with it, shown in open position in FIG. 4. The selection panel doors 103, 105 may be mechanically and electrically locked into closed position.

Figure 5:
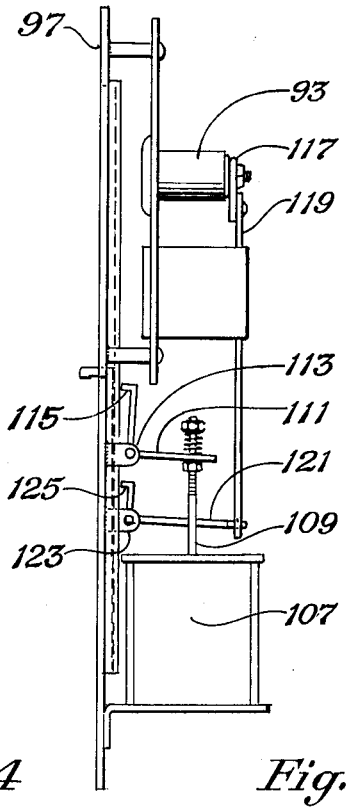
FIG. 5 is a side elevational view of the maid portion of the selector panel of FIG. 4.

On the maid selection portion, a solenoid 107, shown in FIG. 5, is mounted to the rear side of wall panel 97. An actuating push rod 109 extends upwardly from the solenoid 107. An L-shaped bracket 111 is pivotally attached at the end of push rod 109, and by a hinge 113 at the L-intersection to the rear side of wall panel 97. The other side of bracket 111 extends upwardly from hinge 113 and has a lip 115 facing the rear side of wall panel 97. The solenoid 107, push rod 109, and bracket 111 hold the sliding selector panel door 77 closed until actuating, then let it drop.

An arm 117 is fixed to the back of the rotating member of mechanical lock 93. A tie rod 119 is pivotally attached to arm 117 and extends downwardly to a point below the selection panel door 103. A second L-shaped bracket 121 is attached to the tie rod 119 and to a hinge 123 at the bracket's L intersection. The other side of bracket 121 extends upwardly from hinge 123 and has a lip 125 facing the rear side of wall panel 97. Tie rod 119 and bracket 121 serve as tripping means for preventing the selector panel door 103 from dropping far enough to provide access to multiposition switch 81 once solenoid 107 is activated. Access is provided to mechanical lock 93 by solenoid 107 activation, and rotation of lock 93 draws lip 125 away from the panel wall 97, allowing the selector panel door 103 to slide fully open. Mechanical lock 93 requires a different key than the outside maid mechanical lock 21.

Figure 6:
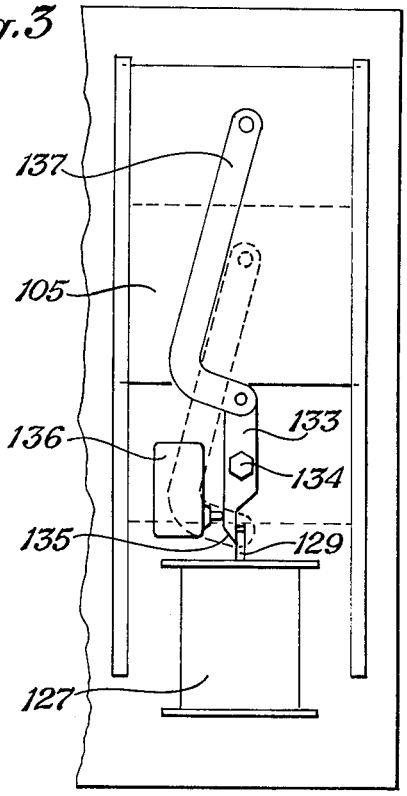
FIG. 6 is a rear view of the guest portion of the selector panel of FIG. 4.

On the guest selection portion, shown in the rear view in FIG. 6, a solenoid 17 is mounted to the rear side of wall panel 97 below the guest selection panel 79 with a push rod 129 extending upwardly. A second mechanical lock 131 is mounted to the wall panel 97 above the solenoid 127 and below the guest multiposition switch 83. The lock 131 is thus accessible from the inside of the hotel room. An arm 133 is attached to the rotating member 134 of lock 131, its lower end engaging with push rod 129 so that the push rod prevents rotation of lock 131 unless the push rod is withdrawn by energizing solenoid 127. A bevel 135 on the arm 133 allows the lock 131 to be rotated back into fully closed position even if solenoid 129 has returned to its extended non-energized state. A limit switch 136 is mounted in engagement with arm 133 and is actuated by rotation of lock 131. An overcenter link 137, connected pivotally between arm 133 and selection panel door 105, provides linkage means to raise and lower the door 105, as indicated by the phantom lines in FIG. 6. Guest mechanical lock 131 requires the same key as outside guest mechanical lock 21, and the key is not removable unless lock 131 is closed.

Referring to FIGS. *7a* and *7b*, 10 signal switches or keys 29 are schematically shown. One side, designated the ground side 138 of each key 29, is in parallel with the other keys and is connected through a high impedance resistor 139 and a capacitor 141 in parallel to ground. The other side, designated the high side 142, of each key 29 is connected to multiposition switch 81, which serves as the first selector means for selecting the maid code and transmitting signals selected.

A conventional power supply (not shown) converts A.C. to a 5 volt and 12 volt D.C. supply. A.D.C. battery (not shown) is installed as an alternate to the A.C. power in case of failure.

Multiposition switch 81 has four resettable switches 89 in parallel with each other. Each resettable switch 89 represents a digit in the four-digit code, and each switch 89 has ten contacts 143, representing the ten indicia in the code. Each contact 143 is directly connected to the high side 142 of a key 29, therefore each resettable switch 89 may exclusively engage any one of the ten keys 29. In the position shown in FIG. 7*b*, the selected maid code is 3-4-5-6, corresponding to indicia 85 displayed on the selector panel 77, FIG. 4.

A second selector means for selecting and transmitting the guest code is identical to the first selector means and connected in parallel. The multiposition switch 83 of the guest code has four resettable switches 91 in parallel with each other, each switch 91 corresponding to a code digit. Each switch 91 has ten contacts 145 directly connected to contacts 143 of the maid code, and consequently the high side 142 of each key 129. In the position shown in FIG. 7*b*, the selected guest code is 0-1-2-3, corresponding to indicia 87 displayed on the selector panel 79, FIG. 4.

Each of the four resettable switches 89, 91 in each multiposition switch 81, 83 is connected to the output side of a diode 147, 149. The inputs of each diode 147, 149 are connected to capacitors 151, 153, and each capacitor in turn is connected to one of the four stages 155 of the sequence detector means 163.

Between each diode 147 and capacitor 151, an energizing line 165 connects the resettable switches 89 to a contact 90 of limit switch 75 via a set of isolating resistors 167. Switch means 94 within limit switch 75 is engageable with contact 90 and is at 5 volts potential. A second switch means 96 within limit switch 75 is at ground and is engagable with a contact 92. Limit switch 75 is adjacent mechanical lock 21, and rotation of lock 21 closes limit switch 75, providing 5 volts through switch means 94, contact 90 and line 165 to the resettable switches 89.

Similarily an energizing line 169 contacts the resettable switches 91 to contact 98 of the limit switch 73 via a set of isolating resistors 168. Limit switch 73, attached adjacent the guest mechanical lock 23, has three contacts 98, 100 and 102. Switch means 104 within limit switch 73 (which may or may not be energized, depending on whether the code mode is in house code or guest code, as will be explained below) engages contact 98. Switch means 106 within limit switch 73 is engagable with contact 100 and is at ground. Switch means 108 within limit switch 73 is engagable with contact 102 and is connected to change code switch 41. Consequently assuming the voltage is being supplied to switch means 104, rotation of guest mechanical lock 23 provides 5 volts via contact 98 and line 169 to the resettable switches 91.

If either resettable switch 89 or 91 is energized, depression of a key 29 selected to be in contact with the resettable switches, momentarily grounds the resettable switches through capacitor 141 and resistor 139, providing a negative pulse, which passes through capacitors 151 or 153 to the sequence detector means 163. No pulse is transmitted to the sequence detector means if the resettable switches 89, 91 are not energized, thus mechanical locks 21, 23, and limit switches 73, 75, serve as part of the means for selectively activating the maid code, guest code, or house code.

Third or house code circuit means, designated as numeral 170, is a third connection between keys 29 and the sequence detector means 163, and is shown as a fixed code 1-2-3-4 in the preferred embodiment, although it could be resettable similar to the first and second selection means if desired. Diodes 171 are connected to four selected contacts of the guest multiposition switch 83 and to capacitors 173, each capacitor being connected to a stage of the sequence detector means 163. An energizing line 175 may supply 5 volts to the input of the diodes 171 through isolating resistors 177 if the code mode is in house code. Assuming line 175 is energized, each depression of a key 1, 2, 3 or 4 sends a pulse to a stage 155 of the sequence detector means 163.

Figure 7A:
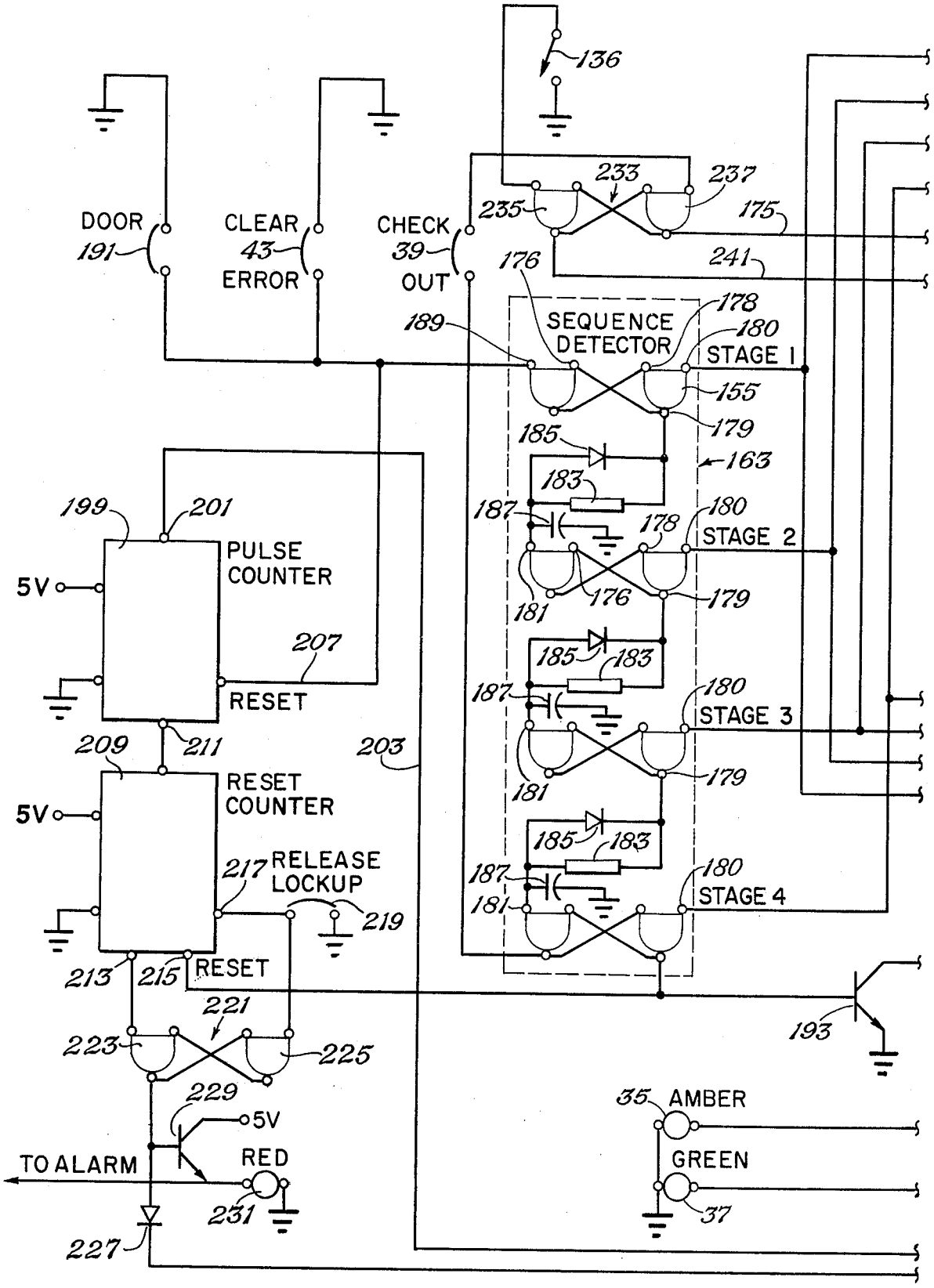
Figure 7B:
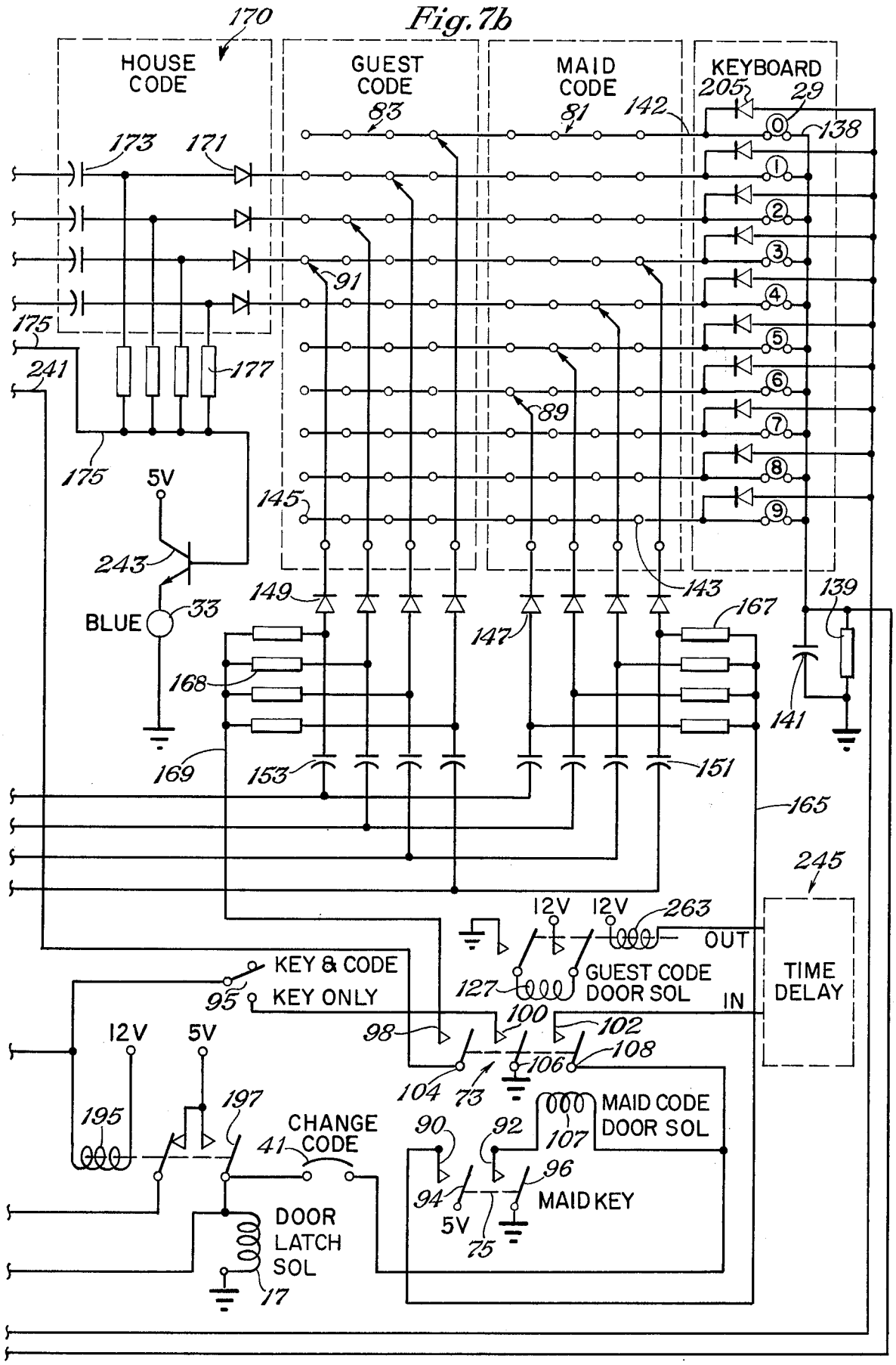

Sequence detector means 163 receives the transmitted pulses, and if they are generated in proper sequential order, provides an output. Each stage 155 is connected to the resettable switch 89, 91 corresponding to its sequential order within the code. Each stage 155 is a bistable element comprising two NAND gates, each having two inputs. The NAND gates on the right side of FIG. 7*a* are designated the "set" side of the bistable element, while the opposite or left side is designated the "reset" side. A 5 volt output from a NAND gate is designated "high"; less than 1 volt is designated "low", and in each bistable element, one gate is at high while the other gate is at low.

One input 176, 178 of each NAND gate is connected to the other NAND gate output. Also each bistable element has an input 180 on the set side connected to the multiposition switches 81, 83 and house code circuit means 170. The outputs 179 of the set gates of the first three bistable elements are connected to an input 181 of the reset NAND gate of the next succeeding stage. Resistors 183 and diodes 185 are connected in parallel between the set output 179 of one stage and the reset input 181 of the next succeeding stage. The diodes 185 are biased to block a positive voltage from the preceding stage to the next succeeding stage. Capacitors 187 connect each reset input 181 of the last three stages to ground. A constant positive voltage will pass from the outputs 179 to inputs 181, however a momentary output is delayed by resistors 183 and capacitors 187.

A reset input 189 of the first stage is connected to a clear error switch 43, the other side of the switch 43 being grounded. Reset input 189 is also connected in parallel to a door switch 191, the other side of door switch 191 being grounded. Door switch 191 is closed by the opening of door 15, thereby grounding the input 189, normally maintained at 5 volts or high. Set inputs 180 are also maintained at 5 volts or high; the capacitors 151, 153 and 173 block this voltage from the multiposition switches 81, 83 and the house code circuit means 170.

A signal from a key 29 to input 180 of stage one drives the reset side low, providing a high output to stage two. A subsequent signal from a key 29 to input 180 of stage two provides a high output to stage three, and also provides a high output to input 176 of stage two reset side. The input 181 of the reset side for stage two is at high because of the prior output of stage one, therefore the stage two reset is driven low, locking the bistable element of stage two into a high output. Stages three and four function in the same manner, changing to a high output only if their reset inputs 181 are at high prior to receiving a signal at their set inputs 180.

If the reset input 181 of a stage is at low, such as if a signal from key 29 is out of sequence, the set side nevertheless will momentarily provide a high output to the succeeding stage. However, the high output is also transmitted to input 176 of the reset side of the same stage. Two low inputs on the reset side leave the reset output at high, and consequently the set output immediately reverts to low. Therefore the bistable element will not change state to provide a high output unless it has previously received a high input at reset input 181. The momentary high output from the set side fails to trigger the next succeeding stage even if the four proper keys 29 are simultaneously depressed because the signal must pass through the resistor 183 and capacitor 187, which delays the momentary high output.

If the signals from keys 29 are received in proper sequential order, stage four provides an output which serves to release door 15. The sequence detector means 163 may be reset by a low input to reset input 189 of stage one. The low input causes the bistable element of stage one to change state, providing a low output that passes through diode 185 to input 181 of stage two. Stage two in turn is driven to a low, and stages three and four follow respectively.

The electrically actuated control means for releasing door 15 is connected to the output of stage four and a transistor 193; the transistor base is connected to the output of stage four, its emitter to ground, and its collector to one side of a relay 195. The other side of relay 195 is supplied with 12 volts. A switch 197 is engagable by the relay; the switch 197, if closed, providing 12 volts. Solenoid 17 is connected to switch 197, which if energized, withdraws latch 19, FIG. 1.

A high output from stage four allows transistor 193 to conduct, grounding one side of relay 145, thereby energizing relay 195, which in turn energizes the door latch solenoid 17. Once the door 15 is opened, switch 191 closes, grounding reset input 189 to stage one of the sequence detector, thereby resetting the stages and changing the high output of the set side of stage four to a low output. This deactivates the relay 195 and door latch solenoid 17.

Amber lamp 35, FIG. 1 and FIG. *7a*, is connected to the switch 197 so that it is on if the door latch solenoid 17 is not energized. Green lamp 37 (,FIGS. 1 and *7a*, is connected to the door latch solenoid 17 and is on only if solenoid 17 is energized.

Error detector means is connected with keys 29 and the sequence detector means 163. The error detector means comprises a pulse counter 199 having an input 201 connected by line 203 to ten diodes 205 in parallel. Each diode 205 is connected to the high side 142 of each key 29. Line 203 is maintained at 5 volts, therefore depression of any key 29, whether selected to be within a code or not, provides a pulse along line 203. The diodes 205 prevent feedback of a signal from a key 29 into one of the selected keys 29 connected to the sequence detector means 163. Pulse counter 199 is also connected by line 207 to reset input 189 of stage one of the sequence detector means 163.

Pulse counter 199 is a conventional binary counter designed to divide by four. After four pulses have been received, a fifth pulse causes the counter 199 to reset itself. A negative pulse output is generated by its reset operation through line 207 to input 189 of stage one of the sequence detector means 163. This low input causes each stage to reset in succession. Consequently if a erroneous key 29, or a key 29 out of order, had been pressed, the sequence detector means will reset automatically before stage four could be triggered since greater than four pulses would be necessary. If only four keys 29 are depressed, and each in proper order, pulse counter 199 has no affect on the sequence detector means 163. Opening of the door 15, through closure of switch 191, resets the pulse counter 199 as well as the sequence detector means 163. Clear error switch 143 also has the same affect of resetting the sequence detector means 163 and the pulse counter 199.

Lock-up means including reset counter 209 is connected to an output 211 of the pulse counter 199. Reset counter 209 is a binary counter that counts the number of resets which pulse counter 199 generates. Reset counter 209 may be set to give a negative pulse through output 213 upon counting a selected number, from 1 to 10, of reset signals received. Reset counter 209 has another input 215 that is connected to the set output of stage four of the sequence detector means 163. Proper actuation of the sequence detector means provides a constant 5 volt signal applied to input 215, resetting counter 209. Another input 217 is connected to a release lock-up switch 219, which if actuated, grounds input 217, resetting the reset counter 209. Release lockup switch 219 is located in a remote and secure area, such as at a hotel desk or manager's office. It is used to release the lock-up means once the number of resets has been exceeded and the electronic lock rendered inoperative. If the selected number of reset signals from the pulse counter 199 is received prior to proper operation of the sequence detector 163, a negative pulse is generated through output 213.

The output 213 of reset counter 209 is connected to a bistable element 221, comprising two NAND gates 223, 225 having two inputs each. The output of each NAND gate is tied to an input of the other. One input of NAND gate 223 is connected to output 213 of reset counter 209, while one input of NAND gate 225 is connected to release lock-up switch 219. The output of NAND gate 223 is connected via a diode 227 to the ground side 138 of keys 29. The output from NAND gate 223 is also connected to the base of an amplifying transistor 229. The collector of the transistor is at 5 volts potential and the emitter is connected to a red alarm lamp 231. The red alarm lamp 231 is maintained in a remote and secure area such at the hotel desk. If 5 volts is applied to the base of transistor 229, it will conduct, activating lamp 231.

A negative pulse from the reset counter 209 causes the bistable element 221 to change state providing a 5 volt output from gate 223. The 5 volts applied to the ground side 138 of keys 29 equalizes the potential on opposite sides of the keys, thereby preventing any signals from being generated and rendering the electronic code circuitry inoperative. If release switch 219 is depressed, the negative pulse to NAND gate 225 drives NAND gate 223 output low, eliminating the 5 volts on the ground side of keys 29 and rendering the code circuitry operative again. Manual resets to the sequence detector means 163 by clear error switch 43 are not counted by the reset counter and do not penalize if the clear error switch 43 is depressed before the fourth signal generated.

Another bistable element 233 is connected to the sequence detector means 163 and serves as part of the code mode switching means to activate either the house code or the guest code. Bistable element 233 comprises two NAND gates 235, 237, each having two inputs. The output of each NAND gate is connected to an input of the other. One input to NAND gate 235 is connected to limit switch 136, which if closed, grounds that input. Limit switch 136 is mounted adjacent the rear guest mechanical lock 131, FIG. 6, such that opening rotation closes the switch 136. Limit switch 136 serves as the third or house to second or guest code switching means.

One input of NAND gate 237 is connected to check-out switch 39, FIG. 1 and FIG. *7a*. The other side of the check-out switch 39 is connected to the reset output of stage four of the sequence detector means 163. Closing switch 39 connects NAND gate 227 to the reset output of stage four. Switch 39 serves as the second to third code switching means.

The output of NAND gate 235 is connected via line 241 to switch means 104 of limit switch 73, which is adjacent guest mechanical lock 23, FIG. 1. If limit switch 73 is closed by the opening of guest lock 23, NAND gate 235 is connected via line 169 to the guest multiposition switch 83. The output of NAND gate 227 is connected via energizing line 175 to the house code circuit means 170.

An output of 5 volts from each NAND gate 235, 237, alternately applies voltage either to the house code circuit means 170, via line 175, or to guest code multiposition switch 83, if switch 73 is closed, via line 241 and line 169. Assuming line 241 is presently activated for guest code use, depressing check-out switch 39 connects the reset output of stage four with an input of NAND gate 237, the latter being responsive to negative signals. If the stage four set output is at 5 volts, which would be the case after proper sequential operation and prior to opening door 15, a low or negative signal would be applied to NAND gate 237 from stage four reset output. The low to NAND gate 237 creates a high output, causing the bistable element 233 to change state, energizing line 175 and de-energizing line 241. House code circuit means 170 is thereby activated and depression of keys 1-2-3-4 provides signals to the respective stages of the sequence detector means 163. A transistor 243 connected to line 175 amplifies the 5 volts from NAND gate 227 to activate blue house code lamp 33, FIG. 1.

If the inside guest mechanical lock 131 is subsequently rotated to close limit switch 136, a low is applied to an input of NAND gate 235. This causes bistable element 233 to change state, providing a 5 volt output on line 241 and de-energizing line 175. Should switch 73 be subsequently closed by rotation of the outside guest mechanical lock 23, 5 volts will be applied to line 169 via switch means 104 and contact 98. Each resettable switch 91 of the guest code selection means thereby will be energized. Bistable element 233, check-out switch 39 and limit switch 136 comprise the code mode switching means, which is a portion of the means for selectively activating either the first selection means, second selection means, or third code circuit means. Other portions of the selective activating means comprise the limit switches 73, 75 and mechanical locks 21, 23, described above.

Access to change the maid code is provided by actuation of solenoid 107 (see FIG. 5 also), which has one side connected to contact 92 of limit switch 75. Contact 92 grounds the maid code solenoid 107 through switch means 96 upon opening rotation of mechanical lock 21. The other side of the maid solenoid 107 is connected to change code switch 41 (see also FIG. 1), which in turn is connected to the door latch solenoid 17. Consequently if the door latch solenoid 17 is energized as a result of proper sequential operation of signals, depressing change code switch 41 applies 12 volts through maid code solenoid 107 to ground via limit switch 75. Maid code door 103 (see FIGS. 4, 5) slides halfway down, stopping at lip 125, exposing inside maid mechanical lock 93. Rotation of lock 93 allows the maid code door 103 to slide fully open, displaying the selected code shown as 3-4-5-6 in FIG. 4.

Access to change the guest code is provided by actuation of solenoid 127 (see FIG. 6 also), which can be actuated only after guest mechanical lock 23 has engaged limit switch 73 and the proper code has been inserted. Switch means 108 of limit switch 73 is connected to change code switch 41, which in turn is connected to the door latch solenoid 17. Contact 102 of limit switch 73 is connected to a time delay circuit 245.

Shown in FIG. 8, the time delay circuit 245 comprises a NAND gate or invertor 247 connected through limit switch 73 to change code switch 41. A limiting resistor 249 between invertor 247 and limit switch 73 reduces the 12 volts supplied from the door latch solenoid 17 and change code switch 41. A monostable element 251, comprising two NAND gates 253, 255, has one input of gate 253 connected to the invertor 247. The output of NAND gate 255 is connected to an input of NAND gate 253. One input of NAND gate 255 is maintained at 5 volts. The other input is connected between the capacitor 257 and the resistor 259, the other side of the resistor being to ground. The output of NAND gate 253 is connected to the other side of capacitor 257 and to the base of transistor 261. The emitter of transistor 261 is at ground and the collector is connected to a relay 263, FIG. *7b*, which has its other side at 12 volts. Activation of relay 263 places one side of guest solenoid 127 at 12 volts and the other side at ground, thereby activating solenoid 127.

A momentary 12 volt signal applied by the change code switch 41 is inverted by invertor 247, providing a momentary low output to NAND gate 253. A high output to transistor 261 results, the high output also transmitting to an input of NAND gate 255. The momentary high output charges capacitor 257, which bleeds off through resistor 259 for a selected time period, thereby maintaining a high at this input of NAND gate 255. This high input drives NAND gate 255 low, changing the monostable element 251 state to a high output at NAND gate 253 which is maintained until capacitor 257 bleeds off to a low. At that time the monostable element shifts back, with a high output on NAND gate 255 and a low output on NAND gate 253.

The high output from monostable element 251 causes transistor 261 to conduct, grounding and actuating relay 263. Relay 263 in turn actuates guest door solenoid 127. Resistor 259 and capacitor 257 are of a size to provide activation for solenoid 127 for a time sufficient for the guest to enter the room with luggage and insert a key in lock 131, preferably from two to five minutes. Should mechanical lock 239 not be rotated to choose a guest code, after the delay period expires the solenoid 127 deactivates and the prior code remains.

If desired, the door 15 may be opened by using key only. Switch 95, FIGS. 4, *7b*, located on the guest selector panel 79, is connected to one side of relay 195, which actuates the door latch solenoid 17. The other side of switch 95 is connected to the contact 100 engagable with switching means 106, which is at ground, of limit switch 73. If placed in key only position, switch 95 closes the connection between relay 195 and contact 100 of limit switch 73. If mechanical lock 31 is then rotated, relay 95 becomes grounded through switching means 106, activating door latch solenoid 17. In key and code position, the switch 95 is open.

As an example of operation, assume the maid code has been pre-set to 3-4-5-6. A key is inserted in front maid mechanical lock 21 and rotated. Control panel door 45 is raised by linkage means 49 to expose the keys 29. Simultaneously, switch means 94 closes on contact 90 of limit switch 75, supplying 5 volts to the four resettable switches 89 of maid multiposition switch 81. Depressing key numbered 3 contacts the ground side 138 with high side 142, generating a negative pulse. The negative pulse passes through diodes 147 and capacitors 151 to input 180 of the stage one bistable element in the sequence detector means 163.

Assuming the sequence detector means to previously have been reset, the negative pulse causes the bistable element to change state, providing a constant high output to stage two. Subsequent depression of the key 29 numbered 4 provides a negative pulse to stage two, providing a high output from the set side. The two high inputs resulting on the reset side of stage two provide a low output, changing the state of the bistable element and providing a constant high output to stage three.

Depression of keys 5 and 6 respectively cause the sequence detector means 163 in the same manner to provide an output from stage four to the electrically actuated control means. Transistor 193 conducts, actuating relay 195, thereby supplying 12 volts through switch 197 to the door latch solenoid 17. Thus the maid can enter independently of the guest's code operation.

While an out-of-order signal from a key 29, or depressing a non-selected key will have no effect on the sequence detector means 163, error detecting means, through pulse counter 199, prevents an output from the sequence detector if more than four keys have been depressed without clear error switch 43 being actuated.

Each reset signal generated by the error detecting means is counted by the lock-up means. Should the number of resets reach a selected number, for example four, reset counter 209 provides a lock-up output.

If the maid is entering after a guest has checked-out, prior to pushing the door 15 open, but after proper generation of signals, she should depress check-out switch 39. Depressing the check-out switch 39 provides a low signal to bistable element 233, driving NAND gate 237 high to supply voltage to the house code circuitry means 170. Once the maid enters, switch 191, in engagement with the door 15, closes, resetting the sequence detector means 163, pulse counter 199, and reset counter 209.

A newly arriving guest is instructed to initially use the house code. The guest uses his key in outside guest mechanical lock 23, rotating the lock to raise front sliding door 45 and to expose the front control panel 11. No voltage is supplied to the guest code multiposition switch 81 by this rotation since switch means 104 of limit switch 73 is at a low output from bistable element 233. The guest must use the house code, shown as 1-2-3-4, in FIG. *7b* and FIG. 4, and lamp 33 indicates this. Depression of the keys 29 in proper sequential order causes the sequence detector means 163 to provide an output to actuate door latch solenoid 17. The operation is the same as during maid operation, including error detector and lock-up provisions.

Should the guest desire, he may continue using the house code, however for greater security, he should select his own code. To do this, after he has generated the proper signals, but prior to opening the door, he should depress change code switch 41. This applies 12 volts to the time delay circuit 245. The guest may immediately withdraw his key and open door 15.

Meanwhile the time delay circuit 245 is providing 12 volts to relay 263, actuating solenoid 127, and will continue to do so for a selected period of time. The guest enters the room and inserts his key in the inside guest mechanical lock 131, which may be rotated only so long as solenoid 127 is actuated. Rotation of lock 131 withdraws selector panel door 105, exposing the indicia of the resettable switches, which then may be rotated to select a new code. Simultaneously limit switch 136 is closed causing bistable element 233 to change state. The house code circuit means 170 is de-energized allowing the guest code to be operable. On subsequent enterings, the guest upon rotating mechanical lock 23 closes switch means 104 with contact 98, applying voltage to the resettable switches 91 of the guest code. The house code is inoperative and door 15 may be opened only by utilizing the newly selected code. Or if the guest desires, it may be turned to mechanical key only position by switch 95.

For security reasons, it may be desirable to frequently change the maid code combination. To do so, an employee must first actuate the maid code in proper sequence. Prior to opening the door 15, change code switch 41 is depressed, energizing solenoid 107. This allows the maid sliding selector panel 103 to drop midway, insufficient to expose the maid multiposition switch 81. After entering the employee rotates inside maid mechanical lock 93, which requires a key different than maid outside mechanical lock 21. This trips the door 103, allowing it to slide down, exposing resettable switch 89, which may then be rotated to select another code. Consequently the maid is unable to reset her own code unless she has the key to lock 93, and is unable to view the code selected by the guest.

It should be apparent from the foregoing that an invention having significant advantages is provided, particularly for hotels. The electronic combination lock allows entrance to three different classes of persons, a newly arriving guest, a guest having a pre-selected code and a maid. For newly arriving guests, a mechanical lock and a simple house code is provided. Once he enters, he may select a code in complete security, even from others who may later be within the room, since the selector panel is secured by code and lock. A maid however may still enter, independently of the guest code, by utilizing a separate and resettable code. Thus, maximum security is provided by a small unit, easily installable in existing buildings. The lock described may also be used in office buildings and apartments.

Although the invention has been described with a certain degree of particularity, it is understood that the present disclosure has been made only by way of example and that numerous changes in the details of construction of parts may be resorted to without departing from the spirit and the scope of this invention.

I claim:

1. An electronic combination lock for a door separating a non-secure and secure area comprising:

a plurality of operator actuable signal switches for generating signals corresponding to a selected code, each signal switch bearing different indicia;

sequence detector means, having a plurality of stages equal to the number of digits in the code, for providing a signal only if each stage receives a signal in proper sequential order;

a first selector means for selecting a first code and transmitting a signal from each of the signal switches selected to be within the first code to the sequence detector means;

a second selector means for selecting a second code and transmitting a signal from each of the signal switches selected to be within the second code to the sequence detector means;

a third code circuit means for transmitting a signal from each of the signal switches set within the third code to the sequence detector;

means for selectively activating either the first selector means, the second selector means, or the third code circuit means to be responsive to the generation of signals by the signal switches selected within each respective code; and an electrically actuated control means connected to the output of the sequence detector means for allowing the door to open in response to signal from the sequence detector.

2. The electronic combination lock of claim 1 wherein the first and second selector means are in parallel with each other and the selector switches, each means comprising:

a resettable switch for each digit in the code each resettable switch being connected to a stage of the sequence detector means and resettable into contact with any of the signal switches; and resetting means, located in the secure area, for manually resetting each resettable switch and for displaying indicia corresponding to the selected code.

3. The electronic combination lock according to claim 2 comprising additionally:

a first cover mounted over the first selector means for enclosing the display and resetting means of the first selector means;

a first mechanical lock mounted in engagement with the first cover for securing the first cover in closed position;

a second cover mounted over the second selector means for enclosing the display and resetting means of the selector means; and a second mechanical lock mounted in engagement with the second cover for securing the second cover in closed position.

4. The electonic combination lock according to claim 2 comprising additionally:

a first slidable door mounted over the first selector means for enclosing the display and resetting means of the first selector means;

a first solenoid mounted in engagement with the first door, and actuable only upon proper sequential generation of first code signals, for releasing the first door;

a second slidable door mounted over the selector means for enclosing the display and resetting means of the second selector means; and a second solenoid mounted in engagement with the second door and actuable only upon proper sequential generation of second code signals or third code signals for releasing the second door.

5. The electronic combination lock according to claim 2 comprising additionally:

a first slidable door mounted over the first selector means for enclosing the display and resetting means of the first selector means;

a first mechanical lock enclosed by the first slidable door located above the display and resetting means of the first selector means;

a first solenoid attached adjacent the first selector means and below the first door, actuable only upon proper sequential generation of first code signals, for releasing the slidable door to expose the first mechanical lock;

tripping means connected pivotally to the first mechanical lock and extending below the first door when the door is in closed position, for preventing the door from sliding sufficiently open to expose the display and resetting means while the mechanical lock is in closed position and for allowing the first plate to open fully when the mechanical lock is rotated;

a second slidable door mounted over the second selector means for enclosing the display and resetting means of the second selector means;

a second mechanical lock exposed to the secure area mounted adjacent and connected to the second door;

linkage means, pivotally connected to the second mechanical lock and the second door for opening and closing the second door upon rotation of the lock;

a second solenoid, mounted in engagement with the second mechanical lock, actuable only upon proper sequential generation of the second or third codes;

means for preventing opening rotation of the mechanical lock unless the second solenoid is actuated; and a time delay means connected to the second solenoid for continuing actuating power to the second solenoid for a selected time interval within which an operator may rotate the second mechanical lock after initial activation.

6. The electronic combination lock according to claim 1 wherein each of the stages of the sequence detector means comprises a bistable element connected to be responsive to a signal from a selected signal switch in proper sequential order, and switchable in response thereto to provide an output for resetting the next succeeding stage and for providing an output to the control means.

7. The electronic combination lock according to claim 1 additionally comprising:

an error detecting means for counting each signal switch actuation and providing a reset output to reset the sequence detector means if the number of actuations exceed the number of digits in the code.

8. The electronic combination lock according to claim 7 wherein the error detecting means comprises:

a first counter responsive to all signal switches actuations that provides an reset output to reset the sequence detector means once the number of actuations exceed the number of digits in the code, the first counter being automatically resettable by proper sequential operation of the sequence detector means prior to receiving signals in excess of the number of digits in the code.

9. The electronic combination lock according to claim 7 additionally comprising:

a lock-up means for counting each reset signal generated by the error detecting means and for providing an output to render the electronic combination lock inoperative if the number of resets generated equals a preselected number.

10. The electronic combination lock according to claim 9 wherein the lock-up means comprises:

a second counter responsive to reset signals generated by the error detecting means that provides an output in response thereto if the number of resets reach a pre-selected number; and a bistable element connected to the second counter and switchable in response thereto to provide an output to render the signal generation from the signal switches inoperative.

11. The electronic combination lock according to claim 1 wherein the means for selectively activating either the first selector means, the second selector means or the third code circuit means comprises:

a first mechanical lock located in the nonsecure area adjacent the signal switches;

a first switch engagable by rotation of the first lock for providing voltage to the first selector means to enable the generation of a signal corresponding to the first code;

a second mechanical lock located in the nonsecure area adjacent the signal switches;

a second switch engagable by rotation of the second lock for providing voltage to the second selector means to enable the generation of a signal corresponding to the second code; and code mode switching means, actuable only after proper sequential generation of signals of either of the codes, for applying voltage exclusively to the third code circuit means or exclusively to the second switch.

12. The electronic combination lock according to claim 11 wherein the code mode switching means comprises:

a bistable element having two outputs, one output being connected to the third code circuit means, the other being connected to the second switch;

second to third code switching means, connected between an output of the sequence detector means and an input of the bistable element, for transmitting a signal from the sequence detector means to the bistable element, the bistable element being switchable in response thereto to provide voltage to the third code circuit means; and third to second code switch means, connected to the bistable element, the bistable element being switchable in response thereto to provide voltage to the second selector means.

13. The electronic combination lock according to claim 11 additionally comprising:

a slidable door mounted over and enclosing the signal switches; and linkage means connected between the first and second mechanical locks and the door for opening and closing the door upon rotation of either lock.

14. The electronic combination lock according to claim 13 wherein the linkage means comprises:

a drag link having one end fastened to the door adjacent one edge;

a whiffle-tree link having one end pivotally connected to the other end of the drag link, and extending laterally toward the first and second mechanical locks;

a first overcenter link having one end pivotally fastened to the first mechanical lock and the other end fastened to the whiffle-tree link intermediate its ends;

a second overcenter link having one end pivotally fastened to the second mechanical lock and the other end pivotally fastened to the end of the whiffle-tree link opposite the drag link; and a ground link pivotally grounded at one end adjacent the door with the other end pivotally connected to the connection of the second overcenter link with the whiffle-tree link;

whereby rotation of the first mechanical lock raises the drag link by rotating the whiffle-tree link about its end connected to the second overcenter link, and rotation of the second mechanical lock raises the drag link by rotating the whiffle-tree link about the connection with the first overcenter link.

15. The electronic combination lock according to claim 1 additionally comprising:

a cover mounted over and enclosing the signal switches; and a mechanical lock located adjacent the cover for securing the cover in closed position.

16. A multiple code electronic combination door lock comprising:

a plurality of operator actuable signal switches for generating signals corresponding to a selected code, each signal switch bearing different indicia;

a first cover mounted over the signal switches;

sequence detector means having a stage for each digit in the code for providing an output if each stage receives a signal in sequential order;

a first selector means for manually selecting a first code, and for transmitting signals from the selected signal switches to the sequence detector means;

a second cover mounted over the first selector means;

a second selector means for manually selecting a second code, and for transmitting signals from the selected signal switches to the sequence detector means;

a third cover mounted over the second selector means;

a third code circuit means for transmitting signals from the signal switches set within the third code to the sequence detector means;

means for selectively activating the first selection means, the second selection means, or the third code circuit means;

error detecting means for counting each signal switch activation and for providing a reset output to reset the sequence detector means upon counting a number in excess of the number of digits in the code;

lock-up means for counting each reset output generated from the error detecting means, and for rendering the electronic combination lock inoperative should the number of reset outputs generated reach a pre-selected number; and electrically actuated control means connected to the output of the sequence detector means for allowing the door to open in response to a signal from the sequence detector.

17. The electronic combination lock according to claim 16 further comprising:

operation switching means, enclosed by the third cover, for selecting the type of operation to be operable by mechanical key only or by mechanical key and code.

* * * * *